United States Patent [19]

Jordá

[11] Patent Number: 4,795,268

[45] Date of Patent: Jan. 3, 1989

[54] EXTRUDED PLASTICS NET BAG

[75] Inventor: José M. Jordá, Cardedeu, Spain

[73] Assignee: Intermas, S.A., Cardedeu, Spain

[21] Appl. No.: 118,254

[22] Filed: Nov. 9, 1987

[30] Foreign Application Priority Data

Apr. 3, 1987 [ES] Spain ..... 8701106
May 25, 1987 [ES] Spain ..... 8701724

[51] Int. Cl.[4] ..... B65D 30/06
[52] U.S. Cl. ..... 383/40; 383/117
[58] Field of Search ..... 383/6, 17, 20, 39, 40, 383/106, 117, 118

[56] References Cited

U.S. PATENT DOCUMENTS

| | | | |
|---|---|---|---|
| 1,390,718 | 9/1921 | Lover | 383/40 |
| 1,975,404 | 10/1934 | Prucha | 383/40 |
| 2,015,119 | 9/1935 | McEwen | 383/40 |
| 2,616,468 | 11/1952 | Brady | 383/117 |
| 2,917,164 | 12/1959 | Kehr | 383/40 X |
| 3,638,784 | 2/1972 | Bodolay et al. | 206/45.34 |
| 3,680,768 | 8/1972 | Warren | 229/56 |
| 4,196,534 | 4/1980 | Shibamoto | 383/117 X |

FOREIGN PATENT DOCUMENTS

| | | | |
|---|---|---|---|
| 0047544 | 3/1982 | European Pat. Off. | 383/117 |
| 0126833 | 12/1984 | European Pat. Off. . | |
| 3300573 | 7/1983 | Fed. Rep. of Germany | 383/117 |
| 2461658 | 3/1981 | France | 383/117 |
| 2519525 | 7/1983 | France . | |
| 0162095 | 9/1970 | Spain . | |
| 2143504 | 2/1985 | United Kingdom . | |
| 2157262 | 10/1985 | United Kingdom . | |

*Primary Examiner*—Stephen Marcus
*Assistant Examiner*—Nova Stucker
*Attorney, Agent, or Firm*—Bell, Seltzer, Park & Gibson

[57] ABSTRACT

The bag is formed by a tubular net body forming, in the flattened state, two superimposed sheets. For housing labels or other supports with graphic representations, the bag is provided with a flattened tubular bag-like strip superimposed on one of said sheets; the strip is attached to the bag, on the one hand, by a weld line forming the bottom of both and, on the other and, by two weld portions connecting the handles to the bag; between these portions there is defined an opening or mouth of the bag-like strip; said strip may be made from transparent plastics sheet or net material.

6 Claims, 2 Drawing Sheets

FIG. 1
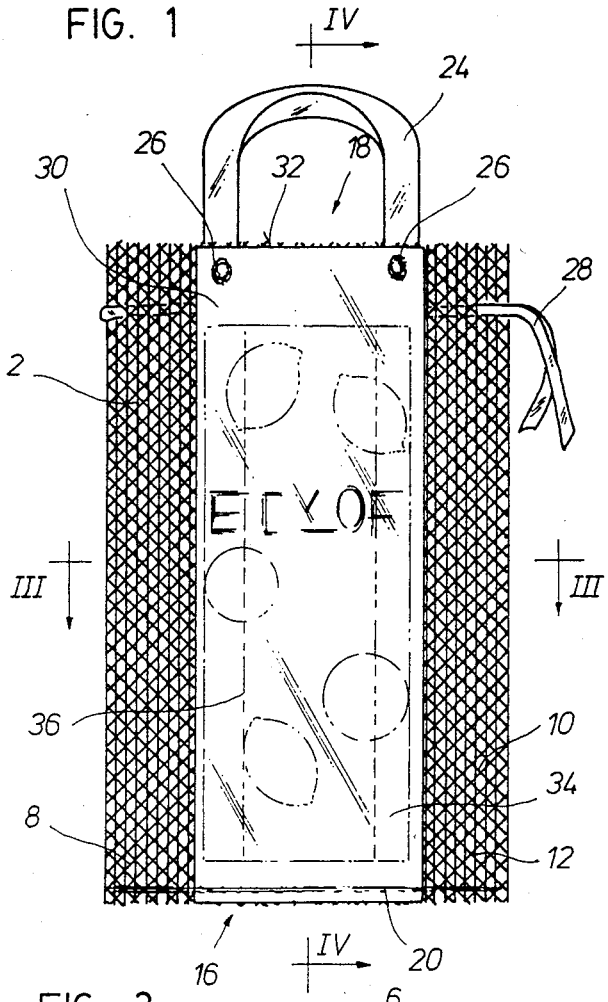
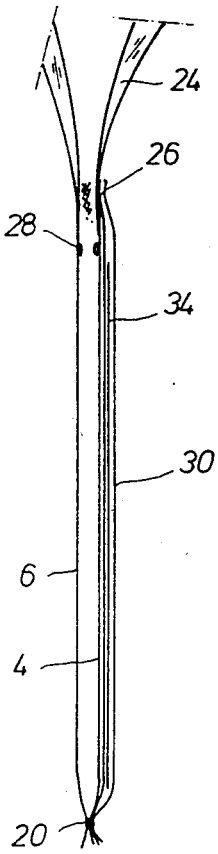
FIG. 4
FIG. 3
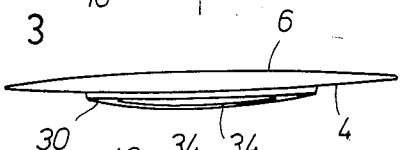
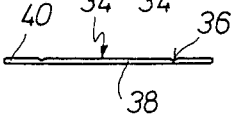
FIG. 5
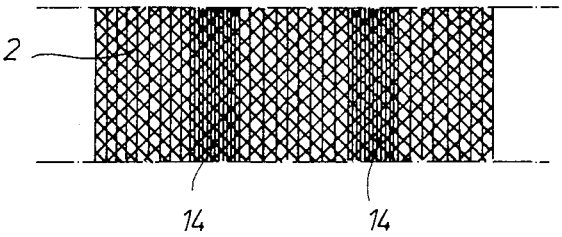
FIG. 6

EXTRUDED PLASTICS NET BAG

DESCRIPTION

1. Field of the Invention

The invention relates to an extruded plastics net bag formed by a tubular net body defining, in flattened state, two superimposed sheets and which comprises: a mouth, longitudinal web portions on each of the sheets, which are reinforced by having a senser mesh than the rest of the bag body; two handles of a plastics material capable of being welded to the plastics material of the bag body, each handle having the ends thereof attached to regions of the reinforced longitudinal web portions by way of weld portions; and a bottom formed by a weld line connecting said sheets together.

2. Description of the Prior Art

Spanish utility models Nos. 262,498 and 262,499 and their corresponding French Pat. Nos. 2,519,525 and German Application DOS No. 33 00 573.7 assigned to of the present applicant, teach arrangements relating to net bags in which the body of the bag is provided on each of the sheets thereof with web portions reinforced by having a denser mesh structure than the rest of the bag body, there being nevertheless interstices between the strands forming said web portions such that said web portions are permeable. There are also described handles which are weld connected to the reinforced web portions and also the formation of the bag bottom by welding.

These arrangements have signified substantial advantages, particularly in that they provide the said reinforced web portions as an improvement over web portions reinforced in the form of a compact impermeable tape. Net bags having the latter type of web portions suffer from the drawback of its not being possible to close the bag bottom by welding. Thus, in the case of compact impermeable web or tape portions, if the weld is sufficiently energetic to provide a bond between superimposed compact web portions, it may be excessively energetic for the rest of the body, cutting the mesh structure. On the contrary, if the weld is gentle so as not to damage the mesh structure, it may be insufficient to connect the reinforced web portions together. Therefore, the formation of the bag bottom in such bags has usually been effected by sewing, stapling or like means, requiring the application of elements foreign to the bag, such as sewing threads or staples, making the bag manufacture more difficult and hindering automated manufacture. Where the bag bottom is welded, such bottom is weak.

Particularly when the bag is for holding delicate fruit, the compact impermeable web portions also suffer from the drawback that the pieces of fruit in contact with the web portions may deteriorate easily for lack of sufficient aireation.

Furthermore, the regular fact that the compact tapes represent a thickening of the bag body, with the corresponding sharp edges, leads to a further drawback consisting of erosion of the fruit contained therein.

Finally, it is also pointed out that the connection of the handles to the bag body by welding is not possible in net bags not having reinforced regions, since this would not allow the provision of sufficient mass of plastics material for the weld to be effective.

The known bags are highly appreciated for their qualities of strength, capacity and reliability and, moreover, result from a rational manufacturing process allowing a very high degree of automation, providing cost savings in manfacture. The most usual application thereof is for packaging fresh vegetable produce, particularly oranges and lemons.

Nevertheless, it is known that it is being increasingly required that the bags have labels or the like whereon a great variety of information may be given, much being related to the content, such as the origin and variety of the fruit, weight, size, date of picking or packaging, etc.

Furthermore, the fruit wholesalers and exporters are frequently required by the customer to provide labels or the like containing information relating to the customer himself, such as a trademark, trading style or the like. And it should also be pointed out that the wholesalers and exporters frequently receive the customer's purchase instructions with very short notice, whereby little time is available for labelling.

Spanish utility model No. 162.095 of the applicant discloses an extruded net bag comprises an inserted strip for advertising purposes, containing distinguishing signs, market references, logotypes and the like, said strip being laid upon and attached to one of the bag sheets. This strip is frequently useful, although it must be admitted that it is not very versatile.

In fact, the use of bags having printed advertising strips requires holding an enormous stock of bags formed by large groups of bags, such that there is a bag for each class of label, with all the variety and complexity that this means, apart from the immovilisation of such a stock of bags representing a substantail cost.

Furthermore, it is obvious that the end use of the bags is not compatible with an appropriate conservation of conventional labels, since they may be easily affected by liquids and relatively violent rubbing.

SUMMARY OF THE INVENTION

Bearing the above drawbacks in mind, the invention provides a bag of the type described comprising a flattened tubular strip extending lengthwise on one of said sheets, from the bottom to the mouth and being attached to the bag body, on the one hand, by the weld line forming the bag bottom which, in turn, closes the bottom end of said tubular strip and, on the other hand, by two of the weld portions, between which there is defined an aperture providing access to the interior of the strip which is thus configured as a small bag adapted to contain labels or the like.

Alternatively, according to the invention, said strip may be made from either transparent plastics sheet or a plastic net.

With a bag of the foregoing type, instead of it being necessary to hold an enormous stock of bags, it is sufficient to have an equivalent stock of labels (obviously much less costly), or there is the possibility of printing the appropriate label on a common paper or board support, this printing operation being much more feasible on these supports than on plastics and thus said printing operation may be carried out in a very short time.

Where the strip is a transparent sheetlike material, the label is protected by the strip itself from the undesirable effects of moisture and also from rubbing stresses.

Where the strip is a net material, the bag aireation is better than in the previous case and the label is also protected from rubbing. Furthermore, the ensemble of bag and bag-like strip is more uniform than in the previous case.

BRIEF DESCRIPTION OF THE DRAWINGS

There are described hereinafter in detail certain non-limitative embodiments of the invention, with reference to the accompanying drawings, in which:

FIG. 1 is a front elevation view of a bag according to the invention, comprising a strip of transparent sheet-like plastics material within which there is a label.

FIG. 3 is a schematic cross sectional view on the line III—III of FIG. 1 or FIG. 2, wherein the separation between the various layers and sheets comprising the bag has been exaggerated.

FIG. 4 is a schematic cross sectional view on the line IV—IV of FIG. 1 or FIG. 2, wherein the separation between the various layers and sheets comprising the bag has been exaggerated.

FIG. 5 is a cross sectional view of one embodiment of a label.

FIG. 6 illustrates a transverse portion of either of the two sheets of the bag.

DETAILED DESCRIPTION

Figure 2:
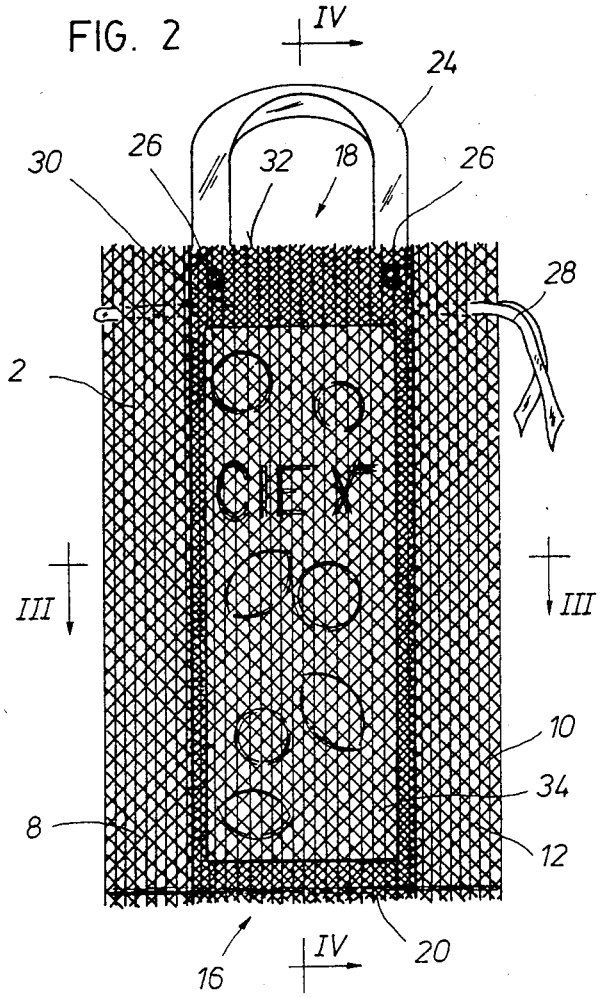
FIG. 2 is a similar view to FIG. 1, the strip being made from extruded plastics net material; the strip, with the two sides thereof flattened, is superimposed on the bag comprising two sheets and the superposition is shown with a thickening of the lines illustrating the corresponding meshes.

The bag is formed by a body 2 of net structure plastics material produced by extrusion. Said body is tubular and in the flattened form thereof defines two superimposable sheets 4, 6 and said net structure comprises strands 8, 10, 12 which may form two or more parallel strand bundles. Thus, in the non-limiting example of the drawing figures, there is a first bundle of parallel strands 8 obliquely disposed relative to the bag, a second bundle of strands 10 also disposed obliquely but in a different orientation from the first bundle, and finally there is a third bundle of strands 12 disposed in the lengthwise direction of the bag.

Each sheet 4, 6 of the bag is provided with two web portions 14 extending from the bottom 16 to the mouth 18 of the bag, i.e. in the lengthwise direction thereof. Said web portions are symmetrically disposed relative to the longitudinal axis of the bag. In said web portions 14, the strands of the net structure are disposed denser than in the rest of the bag body. Nevertheless, between the strands of said web portions 14 there are interstices (i.e. the strands are not juxtaposed) and therefore the web portions are permeable. In the preferred embodiment illustrated, the greater mesh density of the web portions 14 is obtained by providing a larger number of strands 12 in the lengthwise direction of the bag. The respective web portions of each bag sheet are mating, i.e. they are superimposed in the flattened state of the bag.

The bag bottom is closed by one or more lines 20 of welding, which are obviously thicker in the portions of said line 20 corresponding to the web portions 14, since there is a larger amount of plastics material affected by the welding process in said portions. The weld line 20 is illustrated in a simplified manner by straight lines, although in reality the form is an irregular line in which the orientation of the strand bundles has an influence. The portions of the bottom corresponding to the web portions 14 provide the necessary strength to the bag bottom, whereby said bottom responds correctly to the stresses to which it is submitted, which would not happen if the whole weld line had the characterisitcs of the portions other than the reinforced portions.

In turn, the handles 24 are made from a plastics material capable of being welded to the plastics material of the bag body 2 and the ends of the handles mate with regions of the web portions 14 close to the mouth 18, the connection being by portions 26 of welding. This welded connection is possible because of the greater mesh density of the web portions, allowing the provision of a sufficient mass for the weld to be effective.

Further to the said members, the bag is provided with a cord, tape or the like 28 threaded through interstices of the bag close to the mouth 18, such that by pulling the ends of the cord or tape 28, the bag mouth 18 is closed by throttling.

Figure 7:
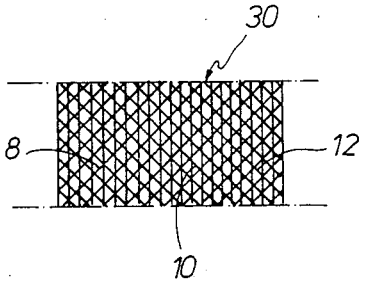
FIG. 7 is a similar view of one of the sides of the strip, this being made from net material.

The bag described is provided, according to the invention with a strip 30 which is tubular and flattened and, alternatively (FIG. 1) it is either a transparent sheet or (FIG. 2) of net structure. The strip (preferably made from polythene or plastified paper) extends lengthwise on the sheet 4, from the bottom 16 to the mouth 18. The strip 30 is connected to the body 2 of the bag by the said welding: the weld line 20 defining the bag bottom 16 and two of the welded portions 26 connecting one of the handles 24 to the bag body 2.

Where the strip 30 is made from net material it is preferably the same extruded plastics material as that forming the bag. Thus it may be seen (FIG. 7) to contain the strands 8, 10, 12 forming two or more parallel strand bundles. The strip 30 does not need reinforced web portions, since it is not subjected to heavy stresses and furthermore a reinforced web portion would tend to hide the label from sight. The visibility of the label without such web portions is quite satisfactory.

The weld line 20 closes the strip 30 at the bottom end and between the said portions 26 there is defined an opening 32 allowing access to the interior of the strip 30 which, in view of the above, is configured as a small flattened bag the ends whereof mate with the weld line 20 and the opening 32 as described. Said opening 32 is obviously narrower than the strip 30.

Said bag-like strip is, therefore, adapted to contain labels or the like 34 which are visible due to the strip being, as said above, transparent or mesh-like. Furthermore, the label is protected.

The label 34, obviously, is narrower than the strip and preferably is inserted by rolling it up slightly so that it may pass through the opening 32 to the interior of the strip where it is easily unrolled. The label may be provided with two lengthwise furrows or folds 36 forming a central portion 38 and two lateral portions 40. Preferably the transverse dimension or width of the lateral portions 40 is less than half the transverse dimension or width of the central portion 38, so that when the side portions are folded to overlap the central portion 38, there is no contact between the lateral portions 40.

To insert the label 34 into the interior of the strip 30, the lateral portion thereof are folded back over the central portion, whereby the width of the label 30 is reduced, and in this way the label is adapted to pass through the opening 32 to the interior of the flattened bag-like strip 30. Under these conditions, the label 34 is unfolded and cannot accidently come out.

It should be noted that the incorporation of the strip 30 to the bag virtually causes no complication as far as the bag manufacture is concerned. In fact, the die cutting operations to form the upper and lower ends of the bag body 2 at the same time define the ends of the strip 30; also, the operation to produce the weld line 20 simultaneously produces the bag bottom and closure of the lower end of the strip 30, attaching it to the bag. Finally, the operation of forming the weld portions 26 to attach the handles 24 to the body 2 provides at the same time the other attachment means of the strip to the bag and also forms the opening 32.

It is obvious, therefore, that the invention provides a bag adapted to receive the appropriate label in each case, that this label is protected by the strip 30, allowing the use of a lower quality label and making it unnecessary to hold stocks of bags classified according to their labels.

I claim:

1. In an extruded plastics net bag formed by a tubular net body defining, in flattened state, two superimposable sheets and which comprises: a mouth, longitudinal web portions on each of said sheets, which are reinforced by having a denser mesh than the rest of the bag body; two handles of a plastics material capable of being welded to the plastics material of the bag body, each handle having the ends thereof attached to regions of the reinforced longitudinal web portions by way of weld portions; and a bottom formed by a weld line connecting said sheets together, the improvement comprising a flattened tubular strip extending lengthwise on one of said sheets, from said bottom to said mouth and being attached to the bag body, on the one hand, by said weld line forming the bag bottom which, in turn, closes the bottom end of the said strip and, on the other hand, by two of said weld portions, between which there is defined an opening providing access to the interior of the strip which is thus configured as a small bag adapted to contain labels means.

2. The bag according to claim 1, further including label means being narrower than said bag-like strip and provided with lengthwise folds forming a central portion and lateral portions facilitating the folding back of the lateral portions over the central portion, thereby reducing the width of the label means and adapting it to pass through said opening into the interior of the bag-like strip, whereupon the label means is unfolded.

3. The bag according to claim 2, wherein the transverse dimension or width of the lateral portions is less than half the width of the central portion.

4. The bag according to claim 1, wherein said flattened tubular strip is made from transparent plastics sheet material.

5. The bag according to claim 1, wherein said flattened tubular strip is made from plastics net material.

6. The bag according to claim 5, wherein said strip is made from the same extruded plastics net material as forms the bag itself, but without having reinforced web portions.

* * * * *

UNITED STATES PATENT AND TRADEMARK OFFICE

CERTIFICATE OF CORRECTION

PATENT NO. : 4,795,268

DATED : January 3, 1989

INVENTOR(S) : Jose Mas Jorda

It is certified that error appears in the above-identified patent and that said Letters Patent is hereby corrected as shown below:

In the Abstract, line 7, "on the other and," should be -- on the other hand --.

Column 1, line 5, delete "1." and center and all cap -- FIELD OF THE INVENTION --.

Column 1, line 17, delete "2." and center and all cap -- DESCRIPTION OF THE PRIOR ART --.

Column 2, line 31, "substantail" should be -- substantial --.

Column 6, line 7, "labels" should be -- label --.

Signed and Sealed this

Sixth Day of June, 1989

*Attest:*

*Attesting Officer*

DONALD J. QUIGG

*Commissioner of Patents and Trademarks*